US008215933B2

(12) United States Patent
Kim et al.

(10) Patent No.: US 8,215,933 B2
(45) Date of Patent: Jul. 10, 2012

(54) SCROLL COMPRESSOR AND REFRIGERATING MACHINE HAVING THE SAME

(75) Inventors: Cheol-Hwan Kim, Seoul (KR); Sung-Yong Ahn, Seoul (KR); Byung-Kil Yoo, Seoul (KR); Yong-Kyu Choi, Seoul (KR); Byeong-Chul Lee, Seoul (KR); Yang-Hee Cho, Seoul (KR); Se-Heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 443 days.

(21) Appl. No.: 12/480,199

(22) Filed: Jun. 8, 2009

(65) Prior Publication Data

US 2010/0092321 A1 Apr. 15, 2010

(30) Foreign Application Priority Data

Oct. 15, 2008 (KR) ..... 10-2008-0101334

(51) Int. Cl.
*F03C 2/00* (2006.01)
*F03C 4/00* (2006.01)
*F04C 18/00* (2006.01)

(52) U.S. Cl. ..... 418/55.4; 418/55.5; 418/55.6; 418/57; 184/6.18

(58) Field of Classification Search ..... 418/88, 418/94, 102, 55.1–55.6, 57, 270; 184/6.16–6.18
See application file for complete search history.

(56) References Cited

U.S. PATENT DOCUMENTS 4,462,772 A * 7/1984 Hazaki et al. ..... 418/55.6
4,743,181 A * 5/1988 Murayama et al. ..... 418/55.4
5,427,511 A * 6/1995 Caillat et al. ..... 418/55.4
5,548,973 A * 8/1996 Komine et al. ..... 62/469
5,660,539 A 8/1997 Matsunaga et al.
5,951,271 A * 9/1999 DuMoulin et al. ..... 418/55.4
6,619,062 B1 * 9/2003 Shibamoto et al. ..... 62/228.3
6,655,172 B2 * 12/2003 Perevozchikov et al. ..... 62/505
7,044,723 B2 * 5/2006 Morozumi et al. ..... 418/55.6
7,322,809 B2 * 1/2008 Kitaura et al. ..... 418/94
2005/0053508 A1 3/2005 Morozumi et al.

FOREIGN PATENT DOCUMENTS

CN 1118842 A 3/1996
CN 1132826 A 10/1996
CN 1339087 A 3/2002

(Continued)

OTHER PUBLICATIONS

European Search Report issued in EP Application No. 09163624.1 dated Mar. 22, 2011.

(Continued)

*Primary Examiner* — Theresa Trieu

(74) *Attorney, Agent, or Firm* — KED & Associates, LLP

(57) ABSTRACT

A scroll compressor and a refrigerating machine including the same are provided. In the scroll compressor, an oil supply hole formed in an orbiting scroll guides oil from a space between a frame and the orbiting scroll to a space between a fixed scroll and the orbiting scroll, and an oil supply groove formed at the fixed scroll maintains communication with the oil supply hole, thereby rapidly supplying oil to a bearing surface between the fixed scroll and the orbiting scroll before the oil is introduced into a back pressure chamber. This enhances compressor efficiency by effectively preventing frictional losses and refrigerant leakage in such a compressor, and enhances energy efficiency for a refrigerating machine using such a compressor.

13 Claims, 7 Drawing Sheets

FOREIGN PATENT DOCUMENTS

| | | | |
|---|---|---|---|
| DE | 10 2005 00146 | | 9/2005 |
| EP | 0 679 809 | | 11/1995 |
| EP | 0 911 526 | | 4/1999 |
| EP | 1 544 467 | | 6/2005 |
| JP | 62-178791 | | 8/1987 |
| JP | 63131889 A | * | 6/1988 |
| JP | 05133355 A | * | 5/1993 |

OTHER PUBLICATIONS

Chinese Office Action issued in CN Application No. 200910158609.0 dated Oct. 26, 2011.

* cited by examiner

SCROLL COMPRESSOR AND REFRIGERATING MACHINE HAVING THE SAME

This application claims priority to Korean Application No. 10-2008-0101334, filed in Korea on Oct. 15, 2008, the entirety of which is incorporated herein by reference.

BACKGROUND

1. Field

A scroll compressor and a refrigerating machine including the same are provided.

2. Background

Scroll compressors compress refrigerant gas by varying a volume of a compression chamber formed by an inter-engaged pair of scrolls. The scroll compressor is efficient, low in vibration and noise, small in size and light in weight, as compared to a reciprocating compressor or a rotary compressor. Scroll compressors have widely been used in a number of different applications, such as, for example, air conditioners. Improved lubrication to the friction parts of the compressor would further enhance performance, reliability and efficiency of both the compressor and the end application in which it is installed.

BRIEF DESCRIPTION OF THE DRAWINGS

The embodiments will be described in detail with reference to the following drawings in which like reference numerals refer to like elements wherein.

DETAILED DESCRIPTION

Figure 1:
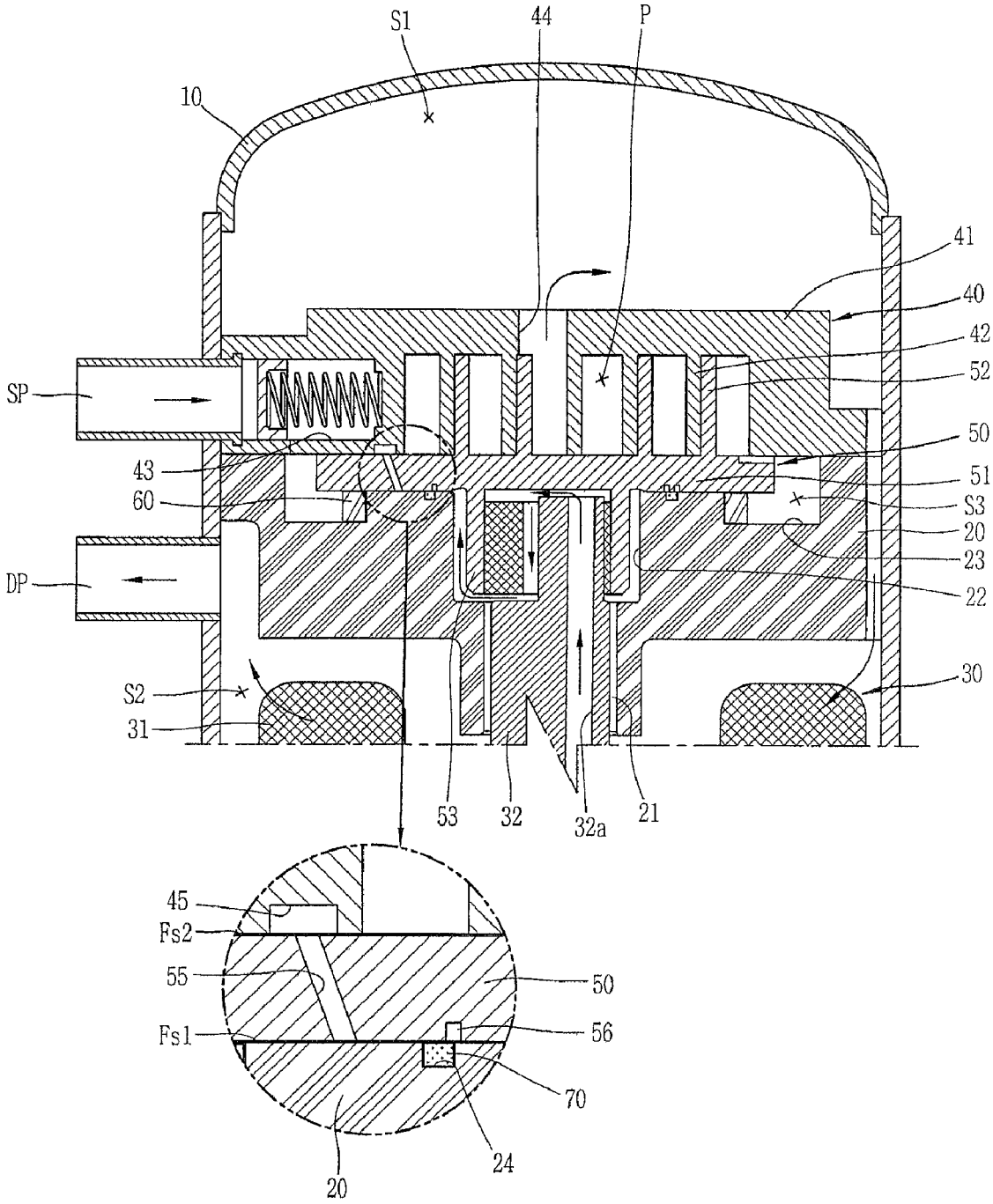
FIG. 1 is a partial cross-sectional view of a scroll compressor as embodied and broadly described herein.
Figure 2:
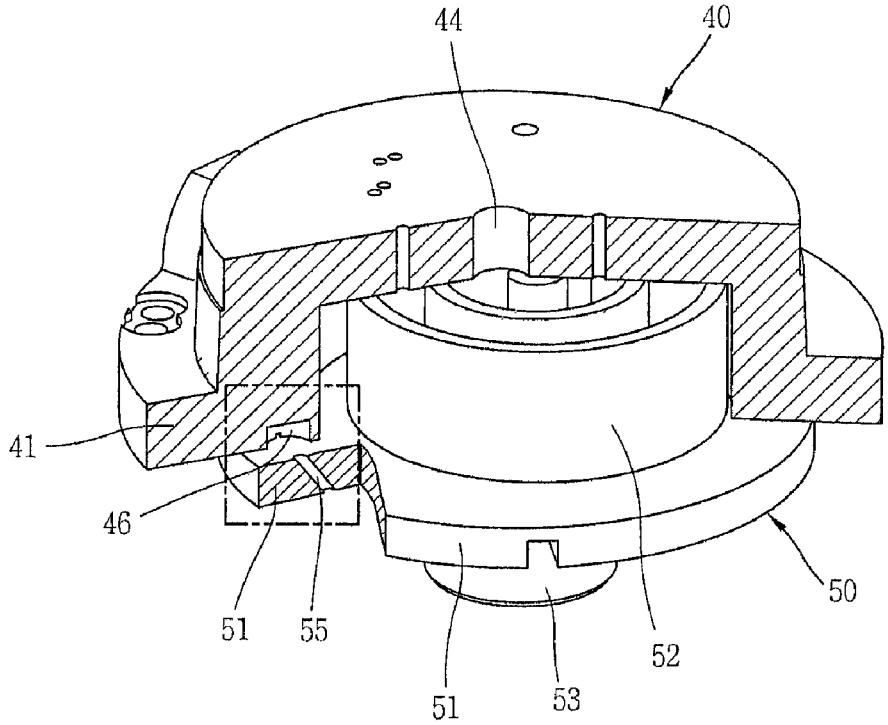
FIG. 2 is a perspective view of a compression part of the scroll compressor shown in FIG. 1.
Figure 3:
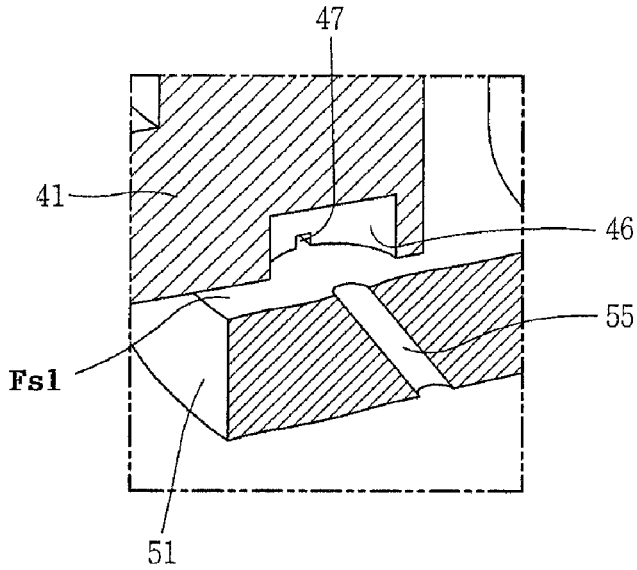
FIG. 3 is an enlarged perspective view of an oil supply channel of the compression part shown in FIG. 2.

Scroll compressors may be divided into high pressure type scroll compressors and low pressure type scroll compressors based on a pressure of a refrigerant provided to an inside of a casing. That is, the low pressure type scroll compressor may be configured such that a suction pipe communicates with an inner space of a casing and a discharge pipe communicates with a discharge side of a compression device, thereby indirectly introducing refrigerant into a compression chamber. On the other hand, the high pressure type scroll compressor may be configured such that a suction pipe directly communicates with a suction side of the compression device and a discharge pipe communicates with the inner space of the casing, thereby directly introducing refrigerant into the compression chamber. For the high pressure type scroll compressor, refrigerant discharged from the compression device may be held in the inner space of the casing.

The high pressure type scroll compressor may use a back pressure scheme to seal a space between a fixed scroll and an orbiting scroll. For instance, a back pressure chamber may be formed at a space defined by the orbiting scroll, a main frame supporting the orbiting scroll, and the fixed scroll, to maintain an intermediate pressure. Oil drawn in through an oil channel of a shaft coupled to the orbiting scroll may pass through a bearing surface between the main frame and the orbiting scroll via an oil reservoir of the main frame, and be introduced into the back pressure chamber. While passing through the bearing surface between the main frame and the orbiting scroll, the oil may be decompressed to arrive at the intermediate pressure environment of the back pressure chamber. Since the pressure of the back pressure chamber is higher than that of the suction chamber, the pressure differential drives the oil in the back pressure chamber into the suction chamber through a bearing surface between the fixed scroll and the orbiting scroll, and into the compression chamber. During this process, the bearing surface between the fixed scroll and the orbiting scroll becomes lubricated, thereby reducing frictional losses.

However, when the scroll compressor is initially operated or is operated in a low-speed operation mode, oil may sometimes not be sufficiently supplied to the back pressure chamber, resulting in an insufficient pressure differential between the back pressure chamber and the suction chamber. Accordingly, oil cannot be smoothly introduced into the bearing surface between the scrolls, thereby lowering compressor efficiency due to frictional losses. In addition, when the scroll compressor is normally operated, in particular, in a high-speed operation mode, oil may be excessively introduced into the back pressure chamber, thereby applying an excessive pushing force on the orbiting scroll against the fixed scroll. Accordingly, the space between the fixed scroll and the orbiting scroll is compressed, an oil passage cannot be formed therebetween, thus lowering compressor efficiency due to frictional losses.

As shown in FIG. 1, a high-pressure scroll compressor as embodied and broadly described herein may include a casing 10 having a hermetic inner space, a main frame 20 and a sub-frame (not shown) respectively fixed to upper and lower portions of the inner space of the casing 10, and a driving motor 30 mounted between the main frame 20 and the sub-frame (not shown) so as to generate a rotation force. A fixed scroll 40 may be fixed to an upper surface of the main frame 20 and directly coupled to a gas suction pipe SP, and an orbiting scroll 50 may be orbitably disposed on an upper surface of the main frame 20, and inter-engaged with the fixed scroll 40 so as to form a plurality of compression chambers P therebetween. An Oldham's ring 60 may be disposed between the orbiting scroll 50 and the main frame 20 to cause the orbiting scroll 50 to orbit while preventing the orbiting scroll 50 from rotating on its axis. A sealing member 70 may be disposed between the orbiting scroll 50 and the main frame 20 so as to block a flow of oil therebetween.

The hermetic inner space of the casing 10 may be divided into an upper space S1 and a lower space S2 by the main frame 20 and the fixed scroll 40. In such a high pressure scroll compressor, the upper space S1 and the lower space S2 maintain a high pressure state, and oil is provided at a bottom portion of the lower space S2 of the casing 10. The gas suction pipe SP may penetrate the casing 10 into the upper space S1, and a gas discharge pipe DP may communicate with the lower space S2 of the casing 10.

A shaft receiving hole 21 may be formed through a center of the main frame 20, and an oil reservoir 22 may be formed at an upper end of the shaft receiving hole 21. A back pressure groove 23 may be formed at an edge of an upper surface of the main frame 20 so as to partially define a back pressure chamber S3. An intermediate pressure may be maintained in the back pressure chamber S3 by mixing refrigerant with oil. The sealing groove 24, which allows the oil contained in the oil reservoir 22 to be maintained at a high pressure, may be formed in a ring shape at an inner side of the back pressure groove 23 to receive the sealing member 70 therein. The back pressure chamber S3 may be defined by the back pressure groove 23 of the main frame 20, a plate portion 41 of the fixed scroll 40, and a plate portion 51 of the orbiting scroll 50.

The driving motor 30 may include a stator 31 that receives external power fixed to an inner portion of the casing 10, a rotor (not shown) disposed inside the stator 31 with a gap therebetween that rotates while interacting with the stator 31, and a drive shaft 32 coupled to the rotor so as to transmit a rotational force from the driving motor 30 to the orbiting scroll 50. An oil supply channel 32*a* may extend through the drive shaft 32 in a shaft direction, and an oil pump (not shown) may be installed at a lower end of the oil supply channel 32*a*.

The fixed scroll 40 may include a fixed wrap 42 involutely formed at a lower surface of the plate portion 41 to form one pair of compression chambers P, an inlet 43 formed at a side surface of the plate portion 41 and in direct communication with the gas suction pipe SP, and a discharge port 44 formed at the center of an upper surface of the plate portion 41 through which compressed refrigerant may be discharged to the upper space S1 of the casing 10.

The orbiting scroll 50 may include an orbiting wrap 52 involutely formed on an upper surface of the plate portion 51 to form one pair of compression chambers P together with the fixed wrap 42 of the fixed scroll 40, and a boss portion 53 formed at the center of a lower surface of the plate portion 51 so as to receive a driving force from the driving motor 30 through its coupling to the drive shaft 32.

In certain embodiments, the fixed scroll 40 and the orbiting scroll 50 may be asymmetrical with each other. For example, a length of the wrap of the orbiting scroll 50 may be longer than that of the fixed scroll 40 by approximately 180°. In alternative embodiments, the fixed scroll 40 and the orbiting scroll 50 may be symmetrical with each other and have substantially the same length of each wrap of the scrolls.

Operation of a scroll compressor as embodied and broadly described herein will now be discussed.

When power is supplied to the driving motor 30 and the drive shaft 32 rotates together with the rotor, a rotation force is transferred to the orbiting scroll 50. The orbiting scroll 50, having received the rotation force, performs an orbiting motion on an upper surface of the main frame 20. One pair of compression chambers P are consecutively moved between the orbiting wrap 52 of the orbiting scroll 50 and the fixed wrap 42 of the fixed scroll 40. As the orbiting scroll 50 continuously performs the orbiting motion, the compression chambers P move inward and are decreased in volume, thereby compressing a refrigerant held therein.

In this condition, the oil pump (not shown) installed at the lower end of the drive shaft 32 starts pumping oil contained in the casing 10, and the oil is drawn upward through the oil supply channel 32*a* of the drive shaft 32. Some of the oil is supplied to the shaft receiving hole 21 of the main frame 20, while some of the oil is dispersed at the upper end of the drive shaft 32 and then passes through a bearing surface Fs1 between the main frame 20 and the orbiting scroll 50, and is introduced into the back pressure chamber S3. The oil in the back pressure chamber S3 serves to support the orbiting scroll 50 such that the orbiting scroll 50 is lifted toward the fixed scroll 40. Then, each end of the fixed wrap 42 and the orbiting wrap 52 closely contacts its respective plate portion 51, 41 of the scrolls, thereby sealing the compression chamber P.

In order for the orbiting scroll 50 to smoothly perform an orbiting motion while being engaged with the fixed scroll 40, oil may be smoothly supplied onto the bearing surface Fs2 between the fixed scroll 40 and the orbiting scroll 50. Further, in order to prevent a leakage of a refrigerant between the fixed wrap 42 and the orbiting wrap 52 or between each wrap 42, 52 and its respective plate portion 51, 41 in the compression chamber P, a certain amount of oil may continuously be supplied to the compression chamber P. However, when the compressor is initially operated or is in a low-speed operation mode, an amount of oil supplied may be relatively small, thereby requiring more oil to be introduced into the back pressure chamber S3. Thus, the amount of oil introduced into the bearing surface Fs2 between the scrolls 40, 50 or the amount of oil supplied to the compression chamber P would be insufficient. On the contrary, when the compressor is normally operated or is in a high-speed operation mode, an amount of oil supplied may be relatively large, thereby providing too much lift to the orbiting scroll 50 and causing excessive contact between the fixed scroll 40 and the orbiting scroll 50, thus causing a shortage of oil in the compression chambers P.

In consideration of these types of problems, an oil supply channel through which some oil may be allowed to be introduced into the suction chamber before the oil moves from the oil reservoir 22 to the back pressure chamber S3 may be provided.

For example, referring to FIGS. 1 to 6, an oil supply hole 55 (a second channel) may be formed in the orbiting scroll 50 such that oil is guided from the bearing surface (hereinafter, referred to as the first bearing surface) Fs1 between the main frame 20 and the orbiting scroll 50 (a first channel), to the bearing surface (hereinafter, referred to as the second bearing surface) Fs2 between the fixed scroll 40 and the orbiting scroll 50, and an oil supply groove 45 (a third channel) may be formed on the bearing surface of the fixed scroll 40 to provide for communication with the oil supply hole 55. In certain embodiments, an inlet of the oil supply hole 55 may be disposed at a position having a greater pressure than the back pressure chamber S3, i.e., within a range (A) along the first bearing surface Fs1 as shown in FIG. 6. An outlet of the oil supply hole 55 may be inclined at a certain angle ($\alpha$) so as to be positioned within a range (B) along the second bearing surface Fs2 as shown in FIG. 6. With this configuration, oil can be smoothly supplied to the second bearing surface Fs2.

For instance, the outermost edge of the orbiting wrap 52 may be, approximately, positioned in a compression chamber range (C) as shown in FIG. 6. Accordingly, if the oil supply hole 55 were formed in a straight line with respect to the shaft direction, the inlet of the oil supply hole 55 would be in communication with the back pressure chamber S3. When the compressor is initially driven or is in the low-speed operation mode, a pressure of the back pressure chamber S3 becomes relatively low, thereby making it difficult for oil to flow through the oil supply hole 55 and provide for smooth oil supply. On the contrary, if the inlet of the oil supply hole 55 is formed on the first bearing surface Fs1 having a higher pressure than the back pressure chamber S3, and if the outlet thereof is in communication with the compression chamber P (i.e., an inner side of the orbiting wrap 52), when the compressor is normally operated, a pressure of the compression chamber P would increase, possibly causing a problem of no oil supply or refrigerant leakage. Therefore, to facilitate the oil supply, the inlet of the oil supply hole 55 is positioned on the first bearing surface Fs1, and the passage formed by the oil supply hole 55 is inclined so that the outlet thereof is positioned near an outer edge of the orbiting wrap 52.

Figure 4:
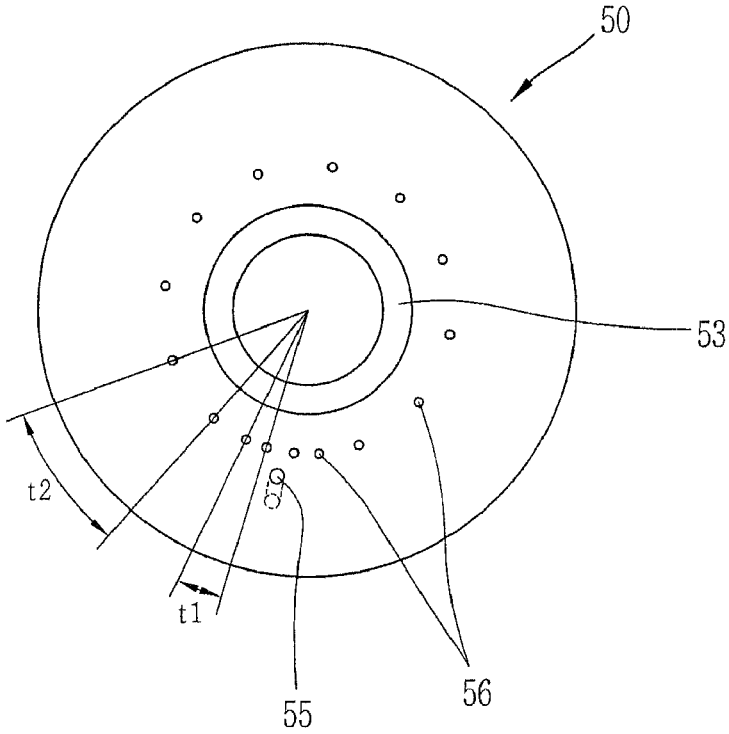
FIG. 4 is a bottom view of an orbiting scroll of the scroll compressor shown in FIG. 1.

A plurality of oil pockets 56 may be formed on a lower surface of the orbiting scroll 50 (i.e., the first bearing surface Fs1) along a circumferential direction such that oil contained inside the sealing member 70 flows to an outside thereof. The oil pockets 56 may have the same interval therebetween, and/or the same size. In certain embodiments, as shown in FIG. 4, the oil pockets 56 may be formed asymmetrical with each other in size and/or interval on the first bearing surface Fs1 of the orbiting scroll 50. That is, in order for the oil in the oil reservoir 22 to smoothly flow to the oil supply hole 55, a distance t1 between the oil pockets 56 at an area near the oil supply hole 55 (e.g., in the range of ±15° based on the oil supply hole 55) may be less than a distance t2 between oil pockets 56 positioned further away from the oil supply hole 55, or a diameter of the oil pocket 56 may be larger in these areas.

Figure 5:
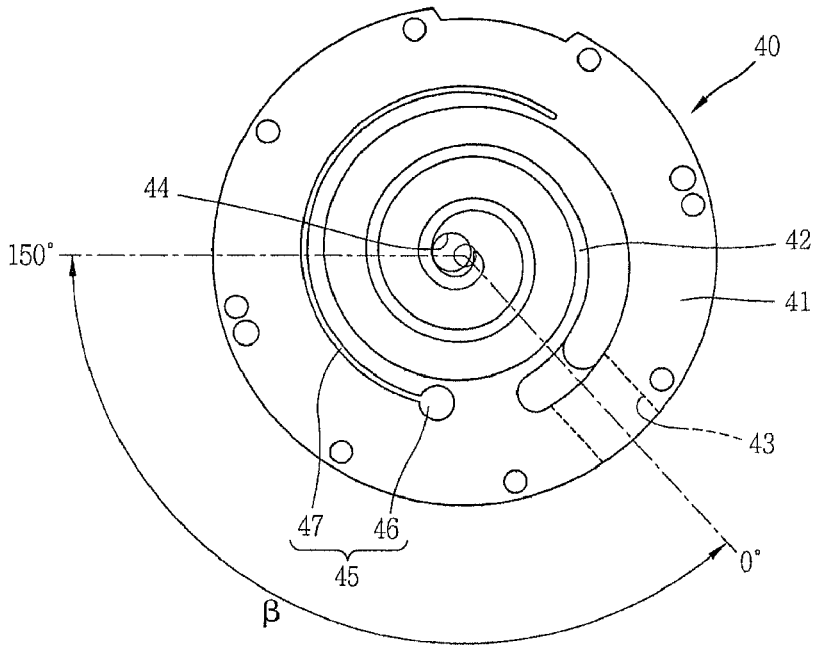
FIG. 5 is a plane view of a fixed scroll of the scroll compressor shown in FIG. 1.
Figure 6:
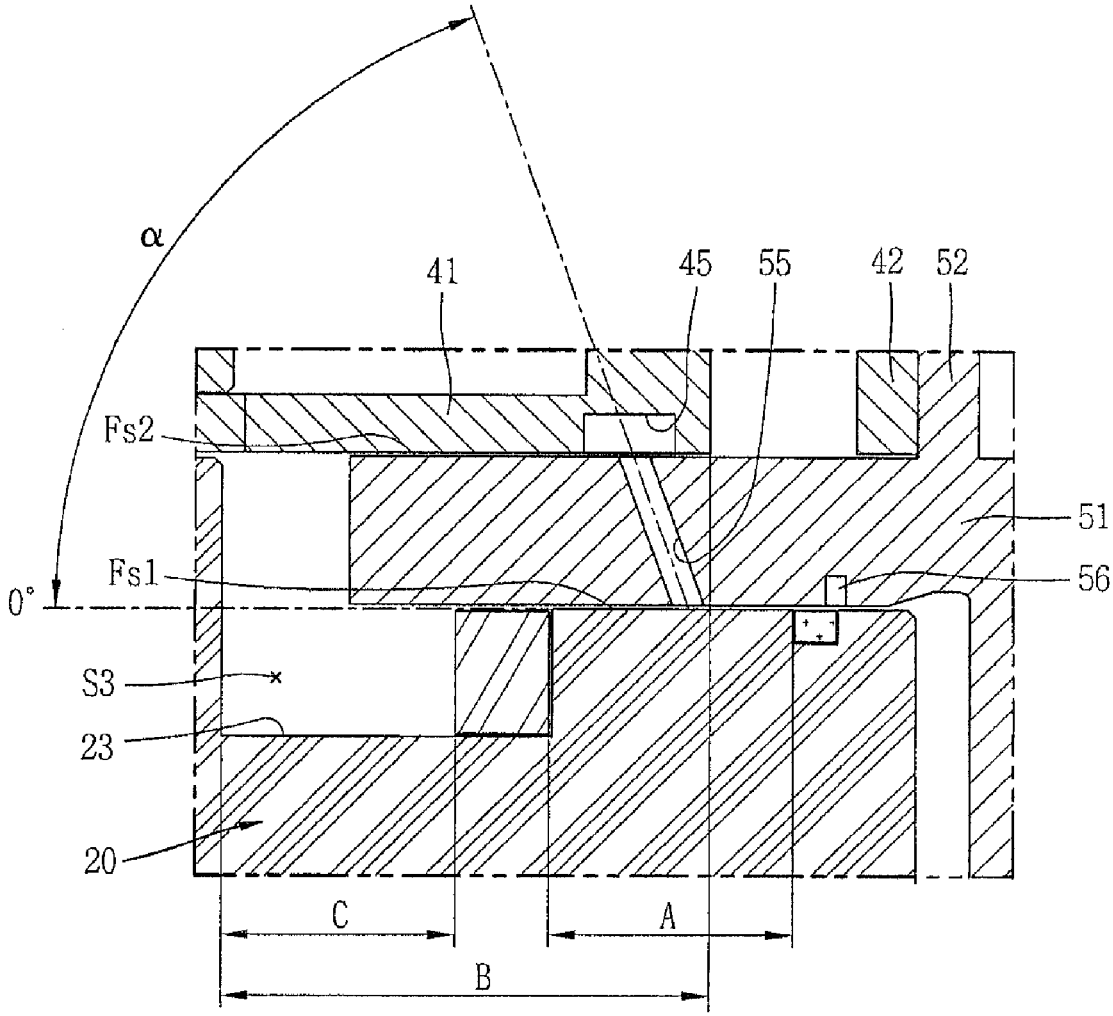
FIG. 6 is a cross-sectional view of an oil supply channel of the scroll compressor shown in FIG. 1.

As shown in FIG. 5, the oil supply groove 45 may be shaped and positioned so that it does not communicate with the back pressure groove 23, i.e., so that it will substantially always be blocked by the orbiting scroll 50. The oil supply groove 45 may include a first groove 46 that maintains communication with the oil supply hole 55, and a second groove 47 in communication with the first groove 46 so as to supply oil to the second bearing surface Fs2.

In certain embodiments, the first groove 46 may be formed in the range of 150°(β) in an orbiting direction of the orbiting scroll, if an area where a frictional resistance is highest on the second bearing surface Fs2 (i.e., the center of the inlet 43 of the fixed scroll 40) is assumed to be at 0°. The first groove 46 may have a diameter greater than that of the oil supply hole 55 so as to maintain communication with the oil supply hole 55, and the second groove 47 may be formed in a circular arc shape.

The second groove 47 may be formed such that an interval between an inner circumferential surface at an end thereof and an inner circumferential surface of the fixed wrap 42 is less than a thickness of the fixed wrap 42. This enables the oil to be smoothly introduced into the compression chamber P from the second groove 47. Further, the second groove 47 may extend toward the suction chamber, thereby deflating the oil supply groove using a pressure difference.

A process of supplying oil to the second bearing surface in a scroll compressor as embodied and broadly described herein will now be discussed in detail.

Figure 7:
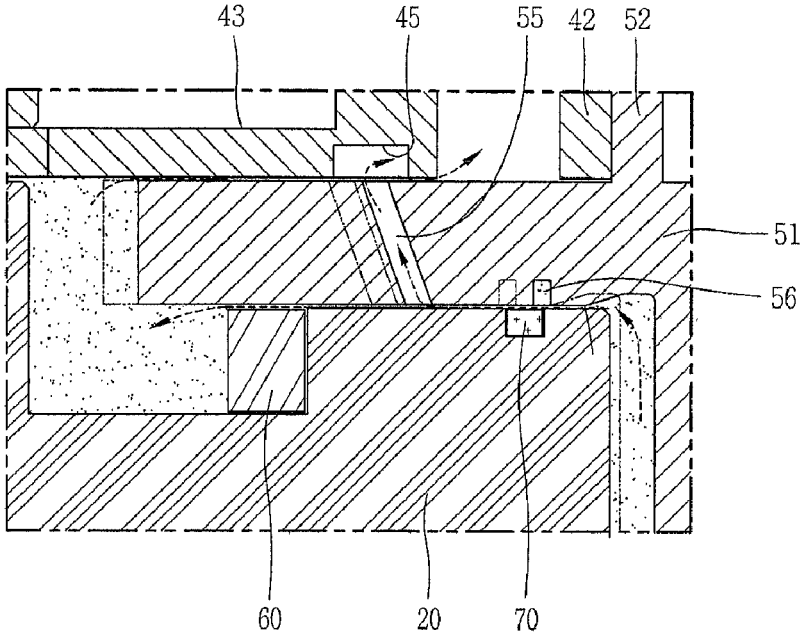
FIG. 7 is a cross-sectional view of an oil supply process in the oil supply channel shown in FIG. 6.

When the drive shaft 32 is rotated, the oil pump (not shown) provided at the lower portion of the drive shaft 32 pumps oil from the bottom of the casing 10 into an upper portion thereof. Some of the oil is directed into the oil reservoir 23 of the main frame 20. As shown in FIGS. 6 and 7, the oil flows to the first channel (i.e., the first bearing surface Fs1) due to a pressure differential, and then flows to the back pressure chamber S3 while lubricating the first bearing surface Fs1. The oil is then introduced into the oil supply hole 55 (i.e., the second channel) by, due to the pressure differential, via the sealing member 70, and is supplied to the first groove 46 of the oil supply groove 45. The oil is widely spread on the second bearing surface Fs2 along the second groove 47 of the third channel, thereby lubricating the second bearing surface Fs2. The sealing member 70, which is provided on the first bearing surface Fs1 between the main frame 20 and the orbiting scroll 50, may interrupt the movement of the oil in the oil reservoir 22 toward the outside of the first bearing surface Fs1. However, the oil pockets 56 formed on the first bearing surface Fs1 of the orbiting scroll 50 may move the oil inside the sealing member 70 toward the outside thereof. In particular, if the oil pockets 56 near the oil supply hole 55 are formed relatively small in size or a diameter of the oil pockets 56 is relatively larger, a greater amount of oil can flow toward the oil supply hole 55.

And, the oil held in the back pressure chamber S3 is supplied to the second bearing surface Fs2 between the fixed scroll 40 and the orbiting scroll 50 through a channel that connects the back pressure chamber S3 to the second bearing surface Fs2, i.e., a fourth channel, due to the pressure differential, and mixed with the oil introduced through the second and third channels, thereby lubricating the second bearing surface Fs2.

Then, the oil, having lubricated the second bearing surface Fs2, is introduced into the suction chamber. The oil is then introduced into the compression chamber P together with the refrigerant, to prevent leakage of the refrigerant from the compression chamber P.

Thus, even if the compressor is initially driven or is in the low-speed operation mode, oil may be supplied to the second bearing surface Fs2 before filling the back pressure chamber S3, thereby preventing an oil shortage at the second bearing surface Fs2. In addition, even if there is excessive contact at the second bearing surface Fs2 when the compressor is normally operated or is in the high-speed operation mode, the oil may be smoothly supplied to the second bearing surface Fs2 through the oil supply hole 55 and the oil supply groove 45.

Figure 8:
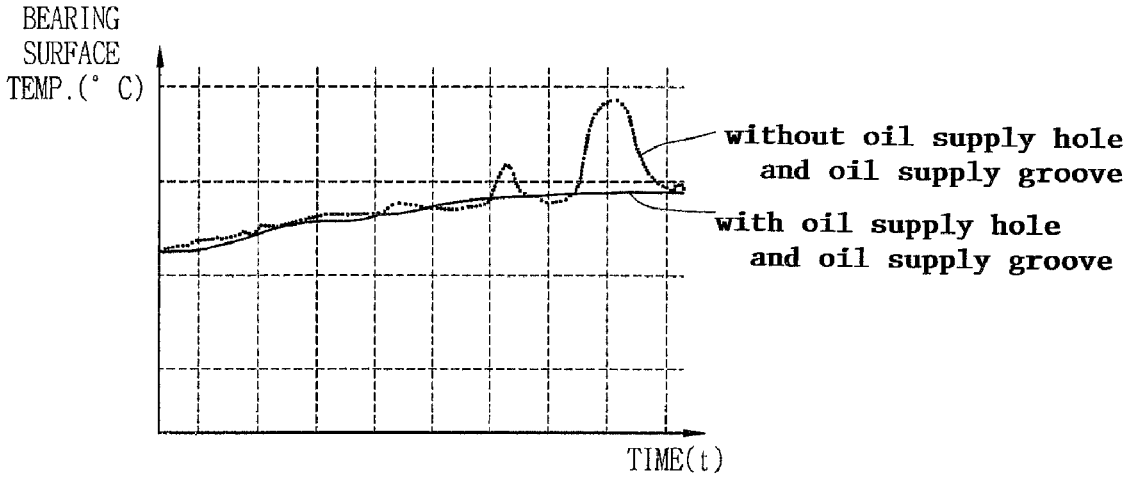
FIG. 8 is a graph illustrating a temperature change on a bearing surface of a scroll compressor as embodied and broadly described herein.

FIG. 8 is a graph illustrating temperature on a bearing surface over time, both with and without an oil supply hole and an oil supply groove as discussed above. Referring to FIG. 8, it is shown that a scroll compressor having the oil supply hole and the oil supply groove as embodied and broadly described herein can maintain a more uniform temperature on the bearing surface without rapidly increasing when compared to a compressor that does not have the oil supply hole and oil supply groove. This is because the oil supply hole and oil supply groove allow the oil to be smoothly and consistently supplied to the bearing surface.

If the scroll compressor as embodied and broadly described herein is applied to a refrigerating machine, efficiency of the refrigerating machine may be enhanced.

Figure 9:
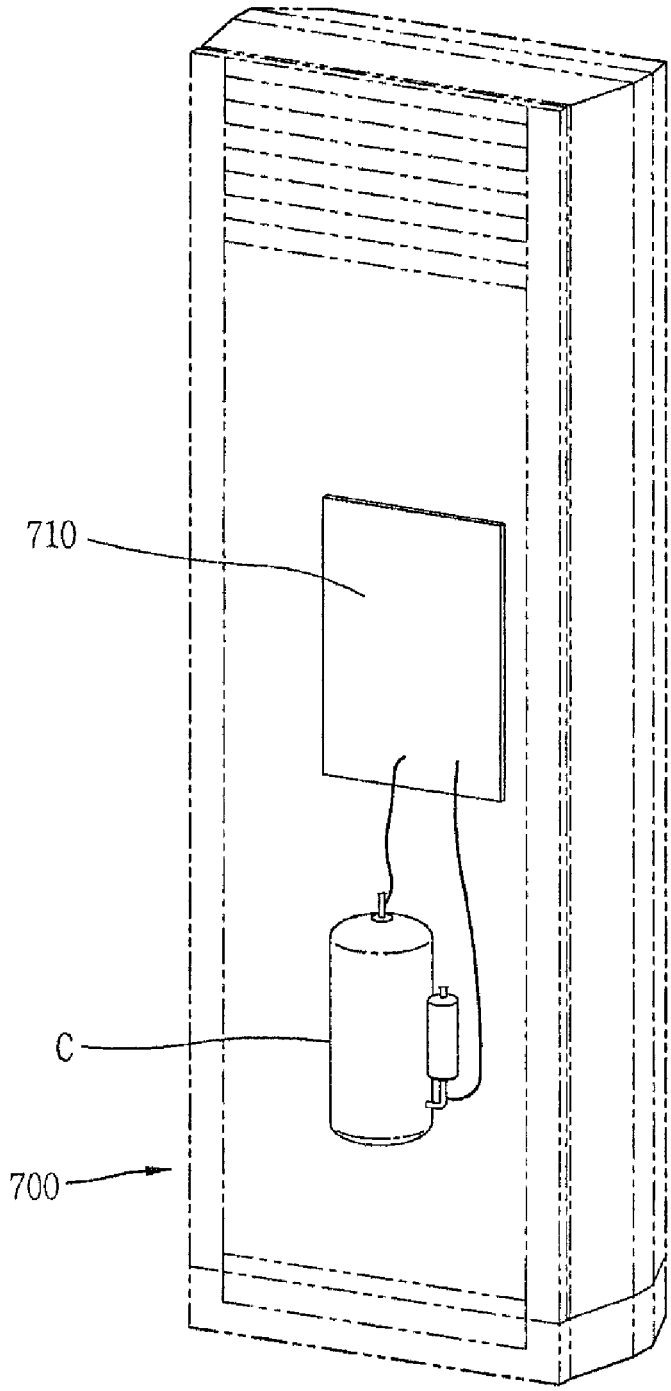
FIG. 9 is a schematic view of a refrigerating machine including the scroll compressor shown in FIG. 1.
Figure 10:
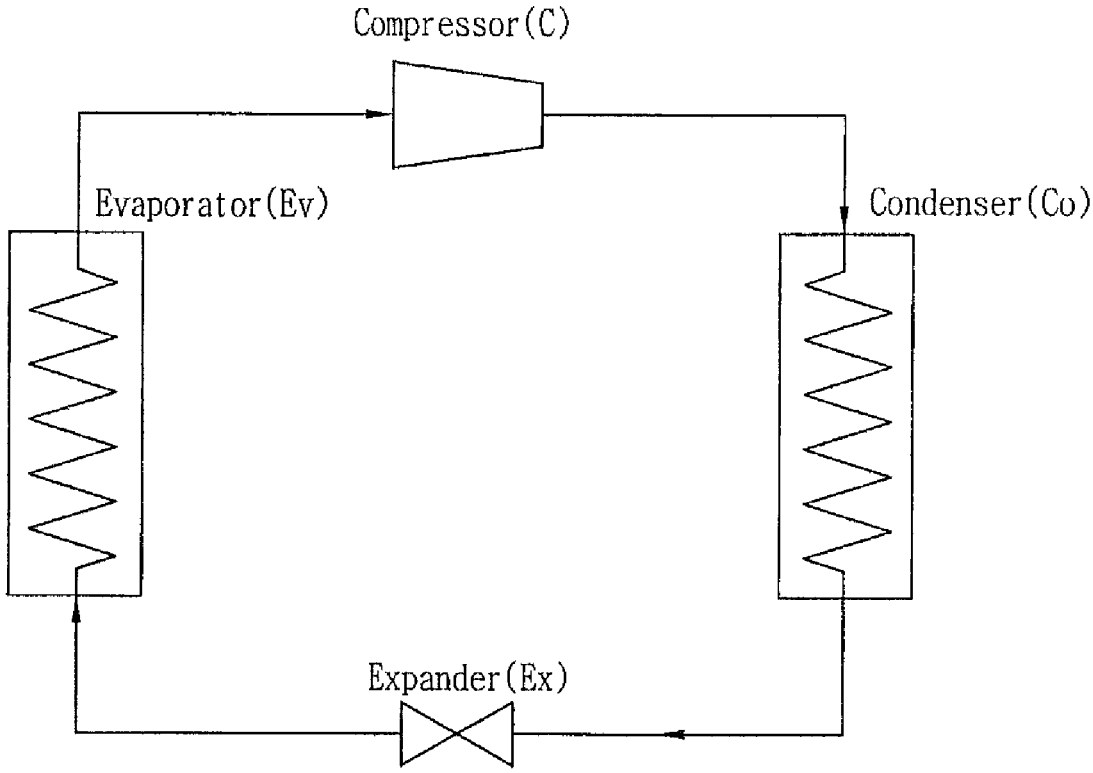
FIG. 10 is a schematic view of an exemplary refrigerating cycle.

FIGS. 9 and 10 show a refrigerating machine 700 which is provided with a refrigerant-compression type refrigerating cycle including a compressor, a condenser, an expander and an evaporator. Inside the refrigerating machine 700, a scroll compressor C is connected to a main board 710 that controls overall operations of the refrigerating machine 700, and the oil supply hole 55 and the oil supply groove 45 are respectively formed at the orbiting scroll 50 and the fixed scroll 40 installed inside the scroll compressor C. Accordingly, some of the oil introduced into the back pressure chamber S3 can be rapidly moved to the second bearing surface Fs2 between the fixed scroll 40 and the orbiting scroll 50 before being introduced to the back pressure chamber S3, thereby smoothly lubricating the second bearing surface Fs2 as well as effectively sealing the compression chamber P by introducing some of the oil to the compression chamber P.

Therefore, compressor efficiency can be enhanced by effectively preventing frictional losses and refrigerant leakage in the compressor, and energy efficiency of a refrigerating machine utilizing such a compressor may also be enhanced.

A scroll compressor as embodied and broadly described herein may be widely used in a refrigerating machine, such as, for example, an air conditioner, a refrigerator/freezer, and the like.

A scroll compressor that is capable of preventing a lowering of compressor efficiency due to a frictional loss by smoothly supplying oil between a fixed scroll and an orbiting scroll regardless of its mode of operation (e.g., an initial operation or a low-speed operation and a normal operation or a high-speed operation) and that capable of enhancing performance of the compressor, and a refrigerating machine having the same are provided.

A scroll compressor as embodied and broadly described herein may include a casing having a hermetic inner space; a frame fixed to the casing and having a back pressure groove at an edge thereof; a fixed scroll fixed to the frame and having an involute wrap at one side surface thereof; and an orbiting scroll disposed between the frame and the fixed scroll, having an involute wrap for forming a pair of compression chambers consecutively moved while performing an orbiting motion by being engaged with a wrap of the fixed scroll, and supported in a shaft direction by a pressure of the back pressure groove, wherein an oil supply hole, through which oil is guided from a space between the frame and the orbiting scroll to a space between the fixed scroll and the orbiting scroll, is formed at the orbiting scroll, and an oil supply groove formed to be always communicated with the oil supply hole is formed at the fixed scroll.

In certain embodiments, a scroll compressor is provided in which a crank shaft of a driving motor is supported by a shaft receiving hole of a frame, a fixed scroll is fixed to the frame, an orbiting scroll coupled to the crank shaft and forming a pair of compression chambers consecutively moved while performing an orbiting motion by being engaged with the fixed scroll is orbitably disposed between the frame and the fixed scroll, and a back pressure chamber is formed on a rear surface of the orbiting scroll so as to support the orbiting scroll in a shaft direction by a pressure of the back pressure chamber, the scroll compressor comprising: a first channel through which oil sucked through the crank shaft is guided to a back pressure chamber through a space between the frame and the orbiting scroll, a second channel through which the oil flowing through the first channel is guided to a space between the fixed scroll and the orbiting scroll, a third channel through which oil in the second channel is widely spread on a bearing surface between the space the fixed scroll and the orbiting scroll, and a fourth channel through which the oil in the back pressure chamber is guided to the bearing surface between the fixed scroll and the orbiting scroll.

A refrigerating machine as embodied and broadly described herein may include a compressor; a condenser connected to a discharge side of the compressor; an expander connected to the condenser; and an evaporator connected to the expander and connected to a suction side of the compressor, wherein the compressor is configured such that an oil supply hole is formed at the orbiting scroll and an oil supply groove is formed at the fixed scroll.

Any reference in this specification to "one embodiment," "an embodiment," "example embodiment," "alternative embodiment," "certain embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing that defines an interior space;

a frame fixed to the casing, the frame having a back pressure groove formed in an upper surface thereof;

a fixed scroll fixed to the frame, the fixed scroll having an involute wrap provided at one side surface thereof;

an orbiting scroll positioned between the frame and the fixed scroll, the orbiting scroll having an involute wrap that is inter-engaged with the involute wrap of the fixed scroll so as to form compression spaces therebetween, wherein the orbiting scroll is supported by a pressure provided by the back pressure groove;

an oil supply hole formed in the orbiting scroll, wherein the oil supply hole guides oil from a space between the frame and the orbiting scroll to a space between the fixed scroll and the orbiting scroll;

an oil supply recess formed in the fixed scroll, at a position corresponding to the oil supply hole;

a sealing member provided at a bearing surface between the frame and the orbiting scroll, wherein the sealing member maintains a pressure in the back pressure groove; and a plurality of oil pockets formed in a lower surface of the orbiting scroll, facing the frame, wherein the plurality of oil pockets direct oil from a radially inward side of the sealing member to a radially outward side of the sealing member as the orbiting scroll orbits.

2. The scroll compressor of claim 1, wherein the oil supply hole extends at an incline from a lower surface to an upper surface of the orbiting scroll, wherein the oil supply hole receives oil flowing along a first bearing surface between the frame and the orbiting scroll and directs the oil upwards to a second bearing surface between the orbiting scroll and the fixed scroll.

3. The scroll compressor of claim 2, wherein a first pressure at the first bearing surface is greater than a second pressure at the second bearing surface, and wherein a third pressure in the back pressure groove is between the first pressure and the second pressure.

4. The scroll compressor of claim 2, wherein the oil supply recess comprises a groove formed in a lower surface of the fixed scroll, at a position corresponding to an upper end of the oil supply hole.

5. The scroll compressor of claim 4, wherein a lower end of the oil supply hole is positioned radially inward from the upper end of the oil supply hole and the oil supply recess.

6. The scroll compressor of claim 4, wherein the oil supply recess is positioned radially inward from the back pressure groove.

7. The scroll compressor of claim 6, wherein the oil supply recess comprises:

a first groove in communication with the oil supply hole; and a second groove that receives oil from the first groove and disperses the received oil onto a bearing surface formed between the orbiting scroll and the fixed scroll.

8. The scroll compressor of claim 7, wherein a cross sectional area of the first groove is greater than a cross sectional area of the second groove.

9. The scroll compressor of claim 7, wherein the first groove has a substantially circular shape and the second groove has a substantially arcuate, semi-circular shape.

10. The scroll compressor of claim 1, wherein a lower end of the oil supply hole is positioned within a bearing surface formed between the frame and the orbiting scroll.

11. The scroll compressor of claim 10, wherein the upper end of the oil supply hole is positioned within a bearing surface formed between the orbiting scroll and the fixed scroll.

12. The scroll compressor of claim 1, wherein the plurality of oil pockets are arranged circumferentially along the lower surface of the orbiting scroll such that an interval between adjacent oil pockets positioned in an area near a lower end of the oil supply hole is less than an interval between adjacent oil pockets further away from the lower end of the oil supply hole.

13. A refrigerating apparatus, comprising:

a compressor;

a condenser coupled to a discharge side of the compressor;

an expander coupled to the condenser; and an evaporator coupled to the expander and to a suction side of the compressor, wherein the compressor comprises:

a casing that defines an interior space;

a frame provided in the interior space, the frame having a back pressure groove formed in an upper surface thereof;

a fixed scroll fixed to the frame;

an orbiting scroll provided between the frame and the fixed scroll and engaged with the fixed scroll so as to form compression spaces therebetween;

a back pressure chamber defined by a portion of the orbiting scroll, a portion of the fixed scroll, and a recess formed in the frame;

an oil supply hole formed in the orbiting scroll, wherein the oil supply hole guides oil from a space between the frame and the orbiting scroll to a space between the fixed scroll and the orbiting scroll;

a sealing member provided at a bearing surface between the frame and the orbiting scroll, wherein the sealing member maintains a pressure in the back pressure groove; and a plurality of oil pockets formed in a lower surface of the orbiting scroll, facing the frame, wherein the plurality of oil pockets direct oil from a radially inward side of the sealing member to a radially outward side of the sealing member as the orbiting scroll orbits.

* * * * *